United States Patent [19]

Ebata

[11] 4,415,143

[45] Nov. 15, 1983

[54] CONTINUOUS HARDENING DEVICE OF STEEL PLATE

[75] Inventor: Sadao Ebata, Kurashiki, Japan

[73] Assignee: Kawasaki Steel Corporation, Hyogo, Japan

[21] Appl. No.: 396,904

[22] PCT Filed: Nov. 27, 1981

[86] PCT No.: PCT/JP81/00356

§ 371 Date: Jul. 6, 1982

§ 102(e) Date: Jul. 6, 1982

[87] PCT Pub. No.: WO82/01894

PCT Pub. Date: Jun. 10, 1982

[30] Foreign Application Priority Data

Nov. 27, 1980 [JP] Japan ..... 55-167102

[51] Int. Cl.[3] ..... C21D 1/64

[52] U.S. Cl. ..... 266/112; 266/131; 266/133; 148/143; 148/153; 134/122 R

[58] Field of Search ..... 266/112, 117, 131, 133; 148/153, 143; 134/64 R, 64 P, 122 R, 122 P

[56] References Cited

U.S. PATENT DOCUMENTS 1,350,618 8/1920 Napier ..... 134/64 R 3,358,980 12/1967 Taylor ..... 134/122 R 3,423,254 1/1969 Sufford et al. ..... 148/153

3,546,911 12/1970 Lenz ..... 148/153

4,039,349 8/1977 Kwasnoski et al. ..... 134/64 R

*Primary Examiner*—L. Dewayne Rutledge

*Assistant Examiner*—Robert McDowell

*Attorney, Agent, or Firm*—Parkhurst & Oliff

[57] ABSTRACT

A continuous hardening device of steel plate of a type wherein steel plate is continuously cooled and hardened by cooling water. The cooling water is continuously supplied into and exhausted out of a water vessel (10) provided in the path of the steel plate for cooling the same. A plurality of rollers (16, 18) supporting the steel plate on the upper and lower sides thereof to feed the same and a plurality of paddle wheels (32, 34) having axial shafts disposed in parallel with the rollers (16, 18) are provided in the water vessel (10). Each paddle wheel (32, 34) is disposed between adjacent rollers and close to the steel plate, and stirs and causes the cooling water to flow along the surface of the steel plate with a predetermined relative speed maintained between the cooling water and the steel plate. The cooling and hardening efficiency of the steel plate is substantially improved by the relative movement of the cooling water and the steel plate.

9 Claims, 4 Drawing Figures

CONTINUOUS HARDENING DEVICE OF STEEL PLATE

TECHNICAL FIELD

This invention relates to a continuous hardening device of steel plate wherein the steel plate is passed through a cooling vessel filled with cooling water circulated therein for hardening the steel plate continuously.

BACKGROUND OF THE INVENTION

It is essential to increase a relative speed between the steel plate and the cooling water for increasing the cooling speed of the same plate and thereby improving the efficiency of the hardening operation. In a known cooling procedure, such a feature has been realized by injecting a pressurized cooling water onto the surface of the steel plate through a plurality of nozzles.

However, such a cooling procedure inevitably requires a large and heavy installation for the pressurized cooling water and a large quantity of the cooling water requiring a high installation and operational cost. Furthermore, it requires water supplying and exhausting pipe lines of a large diameter, necessitating a large installation space and increasing the height and length of the hardening device. In addition, the large and thereby heavy pipe lines and heavy contents therein require an additional reinforcement of the supporting members such as supporting frame and the like, while the pipe line of a large size increases the pitch between pipe lines provided in parallel, thus making it difficult to increase the density of injected cooling water and to maintain a required capability of cooling the steel plate. Furthermore, a problem such as clogging of nozzles tends to result in uneven hardening of the steel plate, and increases the time and labor required for eliminating the clogging of the nozzles.

A cooling device for steel plate has been disclosed in Japanese Patent Publication No. 11247/1978. In this device, there are provided a number of roller pairs supporting the steel plate on the upper and lower sides of the steel plate and a plurality of upper and lower enclosures arranged symmetrically for encasing a pair of the rollers and a part of the steel plate adjacent to the pair of rollers between the upper and lower enclosures. The widthwise and lengthwise ends of the enclosures are closed. Cooling water supply tubes and cooling water exhaust tubes are connected alternately to the enclosures. Narrow spaces provided between the enclosure and the steel plate provide passages of the cooling water along which the heat of the steel plate is dissipated. In this cooling device, however, since the rollers and the steel plate are encased in each enclosure with narrow spaces formed between the enclosure and the steel plate being utilized for passages of the cooling water, a probability of the passages being clogged still exists. When the clogging of the passages occurs, the cooling effect of the cooling device is thereby substantially reduced.

It is an object of the present invention to provide a continuous hardening device of steel plate wherein the above described difficulties of the conventional devices are substantially eliminated, and a desired cooling capability can be maintained regardless of its small-size construction and a reduced consumption of cooling water.

DISCLOSURE OF THE INVENTION

According to the present invention, the above described objects can be achieved by passing the steel plate through a cooling water vessel wherein cooling water is continuously supplied and exhausted for maintaining a circulation of the same, and paddle wheels are provided adjacent to the upper and lower surfaces of the steel plate. The rotation of the paddle wheels accelerates the circulation of the cooling water and forces the same to flow in the feeding direction of the steel plate or in the reverse direction at a predetermined relative speed between the cooling water and the steel plate. By the above described construction of the hardening device, aforementioned clogging of nozzles or blocking of passages in the prior art can be substantially eliminated, and hardening of the steel plate can be carried out efficiently. Consequently, consumption of cooling water can be reduced, and the size of the hardening device can be substantially reduced.

More specifically, a plurality of upper and lower rollers are provided in the vessel for guiding and feeding the steel plate, and the paddle wheels are provided between adjacent pairs of the rollers. The paddle wheels have shafts extending in parallel with that of these rollers, and the paddle wheels are rotated for instance in a direction reverse to the rotating direction of the rollers for maintaining the predetermined relative speed between the cooling water and the steel plate.

PREFERRED EMBODIMENT OF THE INVENTION

The invention will now be described in detail with reference to the accompanying drawings.

Figure 1:
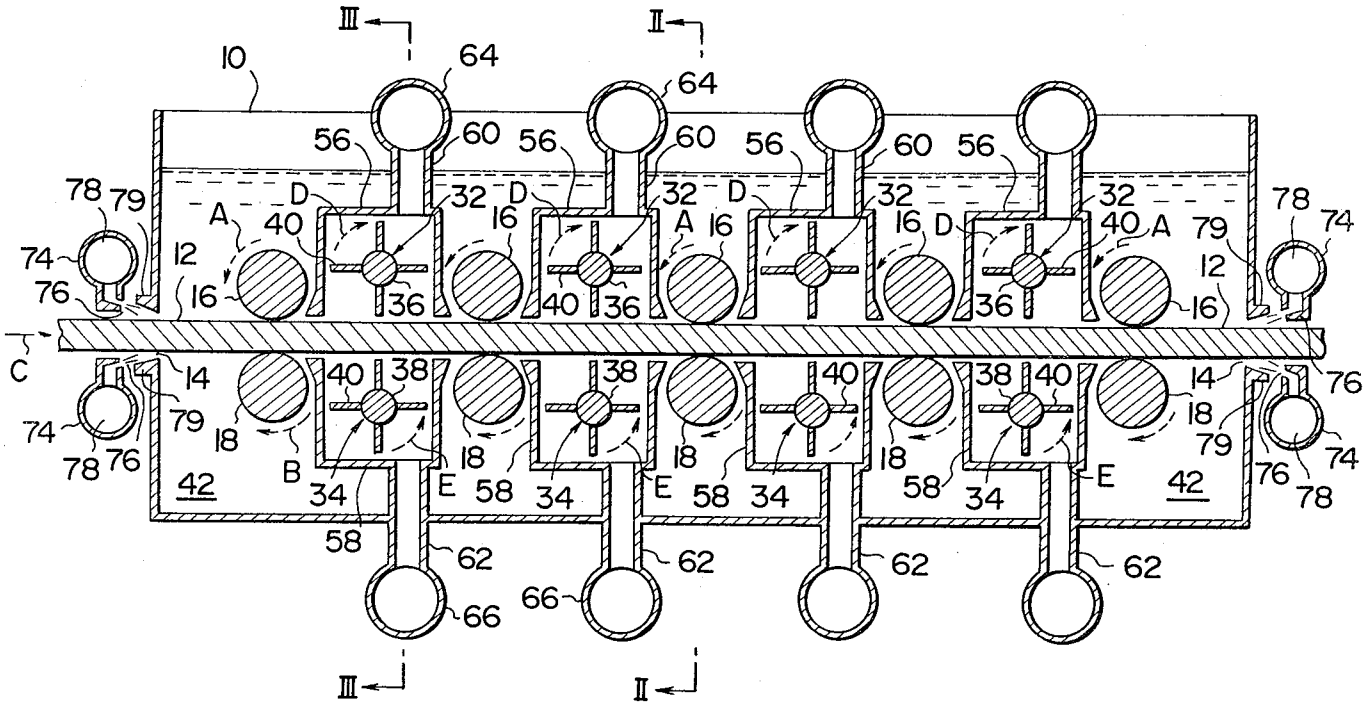
FIG. 1 is a sectional view showing an example of a continuous hardening device of steel plate according to the present invention.

FIG. 1 shows a preferred embodiment of the invention wherein a steel plate 12 is passed horizontally through a water vessel 10 provided for hardening the steel plate 12. The water vessel 10 has rectangular ports 14 at the longitudinal ends thereof for receiving and delivering the steel plate 12 therethrough.

Figure 2:
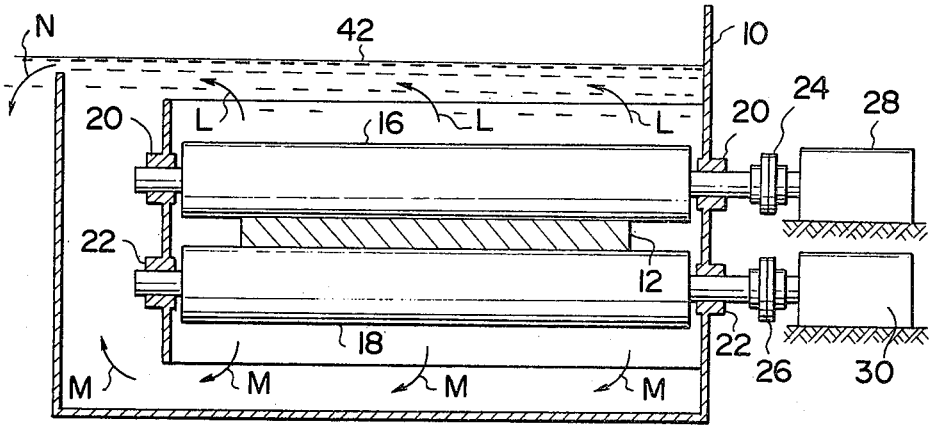
FIG. 2 is a sectional view along the line II—II in FIG. 1.

As best illustrated in FIG. 2, the water vessel 10 includes a plurality of upper rollers 16 and lower rollers 18 aligned symmetrically with each other. An appropriate spacing or gap is maintained between the upper rollers 16 as well as the lower rollers 18 thus aligned. Bearing devices 20 and 22 support both ends of the upper roller 16 and the lower roller 18, respectively. The rollers 16 and 18 extend horizontally and transversely to the longitudinal direction of the water vessel 10. One end of each of the rollers 16 and 18 extending outwardly beyond the bearing devices 20 and 22 is coupled through coupling devices 24 and 26 to driving devices 28 and 30, respectively. When the driving devices are energized, the upper and lower rollers 16 and 18 are rotated mutually reversely (as shown by arrows A and B in FIG. 1) so as to drive the steel plate 12 lengthwise (as shown by an arrow C in FIG. 1) of the water vessel.

Paddle wheels 32 and 34 are provided between two adjacent upper rollers 16 and between two adjacent lower rollers 18, respectively. The axes of the paddle wheels 32 and 34 extend in parallel with those of the upper and lower rollers. Each of the paddle wheels 32 and 34 has four blades 40 projecting radially outwardly from axial shafts 36 and 38 of the paddle wheels 32 and 34 at an equal angular interval therebetween. A gap of less than several tens mm is maintained between the tip of each blade 40 and a surface of the steel plate 12 opposing to the paddle wheel. Accordingly, cooling water 42 is prevented from moving in the direction of the shaft of the paddle wheel, that is, in the widthwise direction of the steel plate 12, thereby to eliminate uneven hardening of the steel plate.

Figure 3:
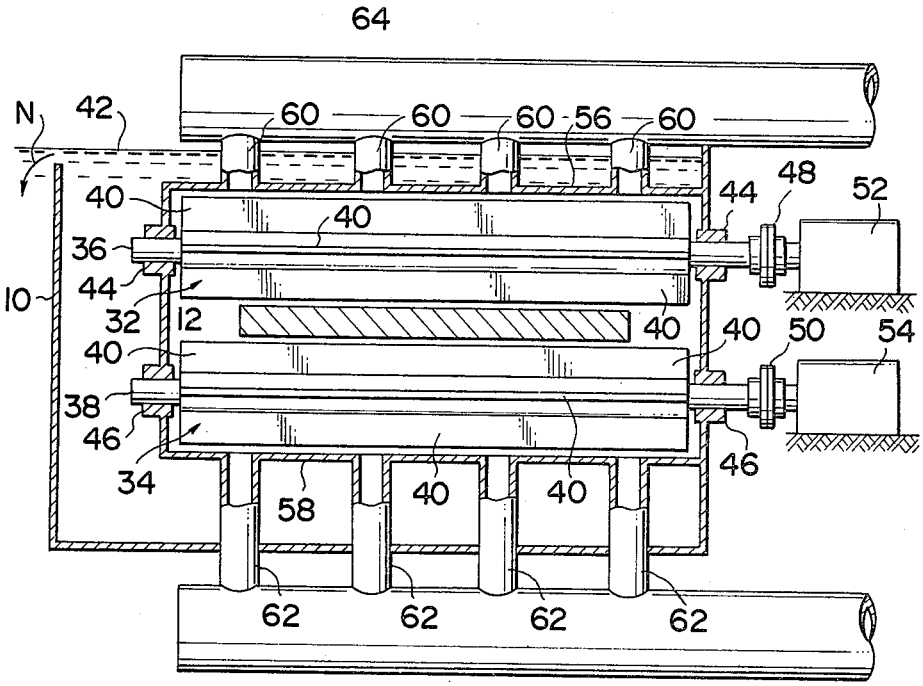
FIG. 3 is a sectional view along the line III—III in FIG. 1.

As shown in FIG. 3, bearing devices 44 and 46 support the axial shafts 36 and 38 of the paddle wheels 32 and 34, respectively. One end of each of the shafts 36 and 38 extends outwardly beyond the vessel 10 through the bearing devices 44 and 46, and is coupled through coupling devices 48 and 50 to driving devices 52 and 54, respectively. When the driving devices 52 and 54 are energized, the paddle wheels 32 and 34 are rotated in the directions reverse to the rotating directions of the upper and lower rollers 16 and 18, respectively. More specifically, the rotating direction of each paddle wheel 32 provided between the two adjacent upper rollers 16 is reverse (shown by arrow D) to that of the upper rollers 16, while the rotating direction of each paddle wheel 34 provided between two adjacent lower rollers 18 is reverse (shown by arrow E) to that of the lower rollers 18. Thus, the cooling water between the steel plate 12 and either one of the paddle wheels is forced by the rotation of the paddle wheel to move in a direction reverse to the transporting direction (shown by arrow C) of the steel plate 12. The driving forces of the driving devices 52 and 54 are so selected that a relative speed of more than 2 m/sec is obtained between the periphery of each paddle wheel 32 or 34 and the steel plate 12.

Each paddle wheel 32 is encased in each of paddle wheel boxes 56, while each paddle wheel 34 is encased in each of paddle wheel boxes 58. The paddle wheel boxes 56 and 58 are each made into a cubic configuration having one side opening toward the steel plate and the remaining five sides providing an envelope for encasing the paddle wheel. The paddle wheel box prevents useless dispersion of cooling water when the water is stirred up effectively by the paddle wheel, and forces the water to be brought into contact with the surface of the steel plate.

A plurality of water supplying branch tubes 60 and 62 are connected at the ends thereof to the paddle wheel boxes 56 and 58, respectively, on the sides thereof remote from the steel plate 12, while the other ends of the branch tubes 60 and 62 are connected to water supplying main tubes 64 and 66, respectively. The water supplying main tubes 64 and 66 are connected to a cooling water supply source (not shown), so that the pressurized cooling water supplied from the cooling water supply source is delivered through the cooling water supplying main tubes 64 and 66 and the cooling water supplying branch tubes 60 and 62 to the paddle wheel boxes 56 and 58. The size of the main tubes 64 and 66 and the number of the branch tubes 60 and 62 are so selected that a sufficient quantity of cooling water is supplied evenly with respect to the longitudinal direction of the paddle wheel boxes 56 and 58 and no uneven cooling is caused along the entire width of the steel plate. Furthermore, the quantity of cooling water supplied from the cooling water supply source (not shown) is so selected that the temperature of the cooling water thus supplied is not raised to such an extent that the hardening operation of the hardening device would be thereby disturbed. The pressure of the pressurized cooling water may be selected to be an approximate value of 0.5 kg/cm$^2$.

Figure 4:
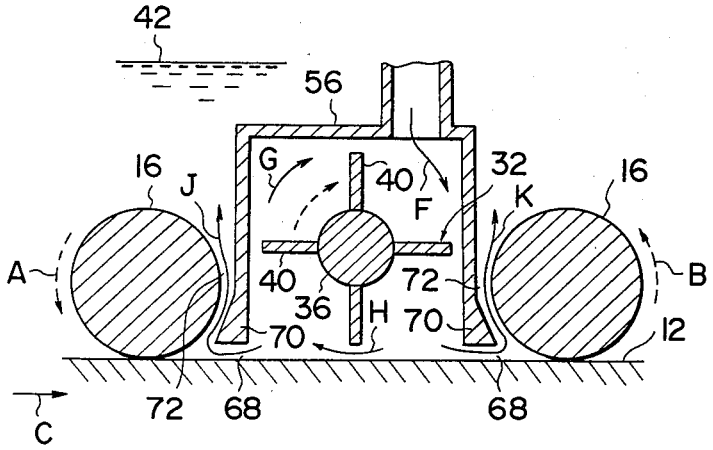
FIG. 4 is an enlarged sectional view of a part of the device in FIG. 1.

As shown in FIG. 4 in detail, the spacing of a gap 68 formed between the opening end of the paddle wheel box 56 (or 58) and the surface of the steel plate 12 is made equal to that of the gap formed between the tip of the blade 40 of the paddle wheel brought nearest to the steel plate 12 and the surface of the steel plate 12, and is formed into a passage of the cooling water flowing from the paddle wheel box 56 (or 58) to the interior of the water vessel 10.

The opening end of the paddle wheel box 56 (or 58) extending toward the steel plate 12 is merged into a thicker wall portion 70 having a thickness gradually increasing toward the steel plate 12. Between the outer surface of the thicker wall portion 70 and the roller 16 (or 18) provided adjacent to the box 56 (or 58), there is formed another gap portion 72 forming another passage continuing with the gap 68, through which the cooling water flows from the box 56 (or 58) to the interior of the water vessel 10.

Outside of each rectangular port 14 of the water vessel 10, through which steel plate 12 is introduced into or delivered from the water vessel 10, there are provided two water supply tubes 74, one on the upper side and the other on the lower side of the steel plate 12. The water supply tubes 74 extend in parallel with the water supplying main tubes 64. A slit nozzle 76 is coupled to each of the water supply tubes 74 for spraying pressurized water 78 sent from the cooling water supply source (not shown) toward the port 14. The opening of the slit nozzle 76 extends along the entire width of the steel plate 12 so that the pressurized water forced out of the slit nozzle 76 spreads in a film-like configuration over the steel plate 12 at an angle of approximately 30°. With the above described arrangement, if the pressure of the pressurized water 78 is selected to be equal to or higher than 10 kg/cm$^2$, cooling water can be prevented from flowing out of the port 14 even in a case where the gap between the steel plate 12 and the surrounding edge of the port 14 is approximately 150 mm. Guides 79 are provided to project from the surrounding edge of the port 14 on both sides of the steel plate 12 for preventing the energy of the pressurized water sprayed out of the slit nozzles 76 from being attenuated after it is sprayed. More specifically, the surfaces of the guides 79 facing the steel plate 12 are tapered for a predetermined angle against the feeding direction of the steel plate 12, and the attenuation of the sprayed energy can be prevented by directing the pressurized water toward the tapered surfaces of the gudes 79. The slit nozzle 76 may be omitted at the port 14 on the delivery side of the water vessel 10 because the hardening of the steel plate has been completed at this position.

As shown in FIGS. 2 and 3, one side wall of the water vessel 10 is made lower than the other side wall so that the cooling water in the water vessel 10 may over-flow along the lower side wall. Furthermore, the water level thus established of the cooling water in the vessel 10 may be so selected that it is higher than the upper surface of the steel plate by several hundreds mm.

The above described embodiment of the present invention operates as follows.

Upon energization of the driving devices 28 and 30, the steel plate 12 is moved in the arrowed direction C. At the same time cooling water from the cooling water supply source (not shown) is supplied under a pressure through the cooling water supplying main tubes 64 and 66 and the cooling water supplying branch tubes 60 and 62 to the interior of the paddle wheel boxes 56 and 58, respectively. Upon energization of the driving devices 52 and 54, paddle wheels 32 and 34 are rotated, and the hardening operation of the hardening device is thereby carried out.

In the above described operation, since the steel plate 12 is firmly seized between upper rollers 16 and lower rollers 18 without slip, occurrence of hardening deformation can be substantially prevented. In addition, the rollers 16 and 18 afford an advantageous feature of shaping the flows of the cooling water on the upper and lower sides of the steel plate 12 in such a manner that the flows are vertically symmetrical with respect to the horizontally extending steel plate 12.

In the paddle wheel boxes 56 and 58, cooling water supplied therein is stirred and moved by the rotation of the paddle wheels 32 and 34 along arrows F, G and H as shown in FIG. 4 in a direction reverse to the moving direction of the steel plate 12. Thus the hardening operation of the device is thereby carried out effectively. The cooling water then flows along arrows J and K through the gaps 68 and 72 away from the steel plate 12. Thereafter, the cooling water flows along arrows L and M as shown in FIG. 2 moving laterally within the water vessel 10, and then is exhausted from the water vessel 10 as an overflow N from a side wall of the vessel 10.

As a result, the steel plate 12 is subjected to the continuous hardening treatment discretely at positions underlying the paddle wheel boxes 56 and 58 while it is moved in its lengthwise direction. The hardening treatment is carried out under the same condition with respect to the lengthwise direction of the steel plate 12, and therefore there is no fear of creating uneven hardening of the steel plate 12.

In a case where it is desired to harden steel plates of different thicknesses in a single and same hardening device, the device may be modified such that the water vessel 10 is made dividable into upper and lower parts so that the intervals between the upper and lower paddle wheels 32 and 34 and the upper and lower paddle wheel boxes 56 and 58 are made variable to accomodate the varied thickness of the steel plate; or otherwise in a manner such that the water vessel 10 is left as it is and only the paddle wheels 32 and 34 and the paddle wheel boxes 56 and 58 are made vertically movable. Furthermore, the slit nozzles 76 may be modified so as to be movable vertically. In the case of first-mentioned modification of the hardening device, appropriate sealing members will be required for sealing between the upper and lower parts of the water vessel 10.

Although an embodiment wherein cooling water is moved in a direction reverse to the moving direction of the steel plate has been described, the cooling water may otherwise be moved in the same direction as that of the steel plate so long as a predetermined relative speed is maintained between the cooling water and the steel plate.

I claim:

1. A continuous hardening device of steel plate wherein steel plate is continuously cooled by cooling water, characterized in that said steel plate is passed through a water vessel into and out of which said cooling water is supplied and exhausted for maintaining a continuous circulation of said water, a plurality of rollers for moving the steel plate and a plurality of paddle wheels located adjacent to the surface of the steel plate are provided in said water vessel, and said paddle wheels stir and cause cooling water to flow at a predetermined relative speed with respect to said steel plate.

2. A continuous hardening device as set forth in claim 1 characterized in that each of said paddle wheels is encased by a paddle wheel box except one side thereof facing the steel plate, and each said paddle wheel box is connected to at least one cooling water supply tube.

3. A continuous hardening device as set forth in claim 2 characterized in that said cooling water is exhausted from said water vessel in a manner that said cooling water overflows one side wall of the water vessel in a lateral direction of the water vessel.

4. A continuous hardening device as set forth in claim 2 characterized in that a gap between said one side of each said paddle wheel box and said steel plate is equal to a gap formed between a tip of each of a number of blades comprising said paddle wheel and said steel plate.

5. A continuous hardening device as set forth in claim 4 characterized in that each of said paddle wheels has an axial shaft disposed in parallel with axes of said rollers, and each of said paddle wheels is arranged between adjacent two of said rollers, and a gap between each roller and the adjacent paddle wheel box is equal to said gap between said one side of said box and said steel plate.

6. A continuous hardening device as set forth in claim 1 wherein said rollers and said paddle wheels are arranged symmetrically on each side of said surface of the steel plate and an interval between corresponding rollers and paddle wheels is adjustable to accommodate various thicknesses of steel plate.

7. A continuous hardening device as set forth in claim 6 wherein said rollers and said paddle wheels are arranged symmetrically on each side of said surface of the steel plate and an interval between corresponding rollers and paddle wheels is adjustable to accommodate various thicknesses of steel plate.

8. A continuous hardening device of steel plate wherein steel plate is continuously cooled by cooling water, characterized in that said steel plate is passed through a water vessel into and out of which said cooling water is supplied and exhausted for maintaining a continuous circulation of said water, a plurality of rollers for moving the steel plate and a plurality of paddle wheels located adjacent to the surface of the steel plate are provided in said water vessel, and said paddle wheels stir and cause cooling water to flow at a predetermined relative speed with respect to said steel plate, each of said paddle wheels having an axial shaft disposed in parallel with axes of said rollers, and each of said paddle wheels being arranged between adjacent two of said rollers.

9. A continuous hardening device as set forth in claim 6 characterized in that each of said paddle wheels is rotated in a direction reverse to a rotating direction of said adjacent rollers.

* * * * *